United States Patent [19]

Deutsch

[11] 4,256,003

[45] Mar. 17, 1981

[54] NOTE FREQUENCY GENERATOR FOR AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 58,882

[22] Filed: Jul. 19, 1979

[51] Int. Cl.[3] ..... G10H 1/00

[52] U.S. Cl. ..... 84/1.01; 84/1.22

[58] Field of Search ..... 84/1.01, 1.03, 1.22; 364/723, 724, 725

[56] References Cited

U.S. PATENT DOCUMENTS

| | | | |
|---|---|---|---|
| 3,639,913 | 2/1972 | Watson | 84/1.01 |
| 3,743,755 | 7/1973 | Watson | 84/1.01 |
| 4,020,332 | 4/1977 | Crochiere et al. | 364/723 |
| 4,036,096 | 7/1977 | Tomisawa | 84/1.01 |
| 4,085,644 | 4/1978 | Deutsch et al. | 84/1.03 |
| 4,114,496 | 9/1978 | Deutsch | 84/1.27 |

*Primary Examiner*—J. V. Truhe

*Assistant Examiner*—Forester W. Isen

*Attorney, Agent, or Firm*—Ralph Deutsch

[57] ABSTRACT

In a musical instrument in which a plurality of data words corresponding to the amplitudes of a corresponding number of evenly spaced points defined a cycle of an audio waveform are transformed at an average rate proportional to the pitch of the tone being generated, a frequency generator is provided using a single master clock source for selectively producing the entire range of musical notes. A non-integer frequency generator is implemented which periodically adds a frequency number, corresponding to an actuated keyswitch, to itself in an adder-accumulator. Overflow pulses from the adder-accumulator address out a set of waveshape values stored in a memory. The noise produced by the unequally spaced overflow pulses is reduced by applying optimal amplitude weighting values to the output waveshape values and then adding the weighted values to provide a single value which is converted to an analog signal and furnished as the musical signal.

14 Claims, 5 Drawing Figures

NOTE FREQUENCY GENERATOR FOR AN ELECTRONIC MUSICAL INSTRUMENT

FIELD OF THE INVENTION

This invention relates to electronic musical tone generators and in particular is concerned with an improvement for generating all the musical notes from a single master timing clock.

BACKGROUND OF THE INVENTION

Keyboard-operated electronic musical tone generators using digital circuit logic are well-known. In the implementation of digital musical tone generators of the types such as the Digital Organ described in U.S. Pat. No. 3,515,792 and the Polyphonic Tone Synthesizer described in U.S. Pat. No. 4,085,644 a set of variable frequency timing clock sources is required for addessing waveshape data that resides in storage memories.

In U.S. Pat. No. 4,085,644 there is described a keyboard musical instrument in which a plurality of tone generators are provided, each tone generator creates a musical tone from a master data list. The master data list consists of the amplitude values of equally spaced points along one cycle of the musical tone which is to be generated. The master data list for each tone generator is stored in a shift register. The amplitude values are shifted out of the register to a digital-to-analog converter at a shift frequency which is directly proportional to the fundamental frequency of the musical note being generated.

As described in U.S. Pat. No. 4,085,644, the shift frequency is derived from a variable frequency oscillator. The frequency of the oscillator is selectively controlled by actuating a keyboard switch on the musical instrument. As assignor circuit stores the actuated switch identification as a musical note in a memory and assigns a tone generator to the actuated switch. The note idenficiation operates as an address of a memory which stores separately addressable frequency control numbers.

The frequency of the oscillator is set according to the frequency control number read out of the memory in response to actuated keyboard switches. Each tone generator in the musical instrument has its own corresponding oscillator. This arrangement permits a number of notes to be generated simultaneously. Each note can be a different musical pitch, or frequency, as in playing a chord. The manner in which such multiple oscillators can be controlled is described in more detail in U.S. Pat. No. 4,067,254 entitled Frequency Number Clock. A method whereby the actuated keyswitches on the keyboard can be assigned to the tone generators is described in U.S. Pat. No. 4,022,098 entitled Keyboard Detect and Assignor.

One serious problem encountered in using a set of variable frequency oscillators is that a musical instrument must be maintained in a proper tuned state. Eash oscillator must accurately reproduce all the required frequencies for the entire range of notes spanned by the instrument's keyboard. Unfortunately variable frequency oscillators are prone to frequency variations with time because changes in the ambient conditions tend to affect the frequency determining circuit components It is difficult and somewhat costly to construct a set of variable frequency oscillators which are stable and accurate in frequency and can be readily tuned to all the notes of the keyboard. If the tuning accuracy is not attained then the pitch of a particular note may depend on which member of the set of tone generators is assigned to a particular actuated keyboard switch.

To alleviate the requirement for a set of accurately tuned variable frequency oscillators, it is desirable to generate the clock pulses for advancing the shift registers in the set of tone generators by deriving the clock pulses from a sngle master clock pulse source. A well-known method for genererating musical frequencies from a single oscillator is to employ what is frequently called a "top octave synthesizer." Such an arrangement uses a set of integer counters. A counter corresponds to each of the 12 notes in the equal tempered musical scale. These counters produce an integer frequency division from the master clock. To produce a set of clock trains corresponding to the frequencies in the top octave of $C_7$ to $C_8$ requires a master clock rate of approximately 2 Mhz. In the polyphonic tone synthesizer described in U.S. Pat. No. 4,085,644 the shift clock frequency must be 64 times the frequency of the note being generated. This would require a master clock frequency which is far too high to be implemented using the present state of the art in large scale integrated microelectronics.

An alternative technique for obtaining a plurality of frequencies from a common clock source is to use a non-integer divider. Such a system was used in the computer musical generation system known as Music V and is described on page 51 of the book:

M. V. Mathews, *The Technology of Computer Music.* The M.I.T. Press, Massachusetts Institute of Technology, Cambridge, Massachusetts and London, England, 1969.

In these systems each actuated keyboard switch is assigned a frequency number. This frequency number when multiplied by the master clock frequency produces the frequency at which data is accessed from a data memory. An objectionable noise-producing problem is inherent in such non-integer frequency divider systems because the frequency number is not a simple integer but instead is some multiple of $2^{1/12}$ which is an irrational number. The use of non-integer dividers for the frequency numbers produces pulse trains at the desired correct average frequency but such pulse trains have intervals between pulses that do not advance at a single constant rate. The number of pulses occurring within a given period of time is varied by eliminating pulses from the master clock at selected intervals controlled by the non-integer frequency number.

A system for using non-integer frequency division from a single master oscillator is described in U.S. Pat. Nos. 3,639,913 and 3,743,755 both of which are entitled Method And Apparatus For Addressing A Memory At Selectively Controlled Rates. Both of these patents describe systems operating on the same principle of memory addressing described in the above referenced book by M. V. Mathews. In these patents a means is disclosed for computing the frequency numbers as an alternative to having these numbers stored in an addressable memory.

If a non-integer frequency divider were used to generate the shift pulses or memory addressing in tone generators such as those described in U.S. Pat. Nos. 4,085,644 and 3,575,792, the unequal spacing of the pulses in the pulse train, or unequal time increments in the addresses, would introduce a highly objectionable noise into the tone generation system. This noise is produced in the form of undesired frequency components which are not harmonically related to the fundamental frequency and produces very displeasing tonal distortion-like effects.

In U.S. Pat. No. 4,114,496 entitled Note Frequency Generator For Polyphonic Tone Synthesizer an arrangement is described for a non-integer frequency divider for synthesizing clock pulse trains at musical frequencies which can be utilized in the Polyphonic Tone Synthesizer described in U.S. Pat. No. 4,085,644. The undesired noise effects are reduced by the method described in U.S. Pat. No. 4,114,496. The noise reduction is accomplished by providing a non-integer divider in the form of a modulo one adder-accumulator which is incremented periodically at the master clock rate by an amount determined by a frequency number selected from a stored set of frequency numbers. This set comprises the binary numbers corresponding to the ratios of the frequency of each note of the keyboard to the frequency of the next highest note on the keyboard. Thus the frequency numbers all have a value less than one. The accumulator adder produces abn overflow pulse whenever the sum exceeds the value of one. The overflow pulses shift successive data words from a register storing a master data set of amplitude values for the tone being generated, the data words being transferred from the register to the input of a digital-to-analog converter. The shift rate determines the pitch of the tone generated by the analog signal from the converter. To compensate for the noise introduced by the irregular pattern of pulses produced by such a non-integer frequency divider, the difference in amplitude between the amplitude values of successive data words in the master data set is generated as each word is shifted out of the register. The difference information is applied to a fractional scaler circuit and is scaled by a fractional amount, then added to the output of the first register, the scale factor being controlled by the highest order bits in the adder-accumulator. For example, using the two highest ratio bits, the scale factors are 0, $\frac{1}{4}$, $\frac{1}{2}$ and 182 .

In U.S. Pat. No. 4,036,096 entitled Musical Tone Waveshape Generator a system is described in which two memories are used to store identical values of a digital musical waveshape. The addressing data consists of a "integer portion and a fraction portion" which gradually increases from zero to a predetermined value and then returns to zero upon reaching the predetermined value. This is essentially the same memory addressing means that was previously described in the above reference book by M. V. Mathews and described in U.S. Pat. Nos. 3,639,913 and 3,743,755. In U.S. Pat. No. 4,036,096 the two data output A and B values from the wave shape memories are combined using a interpolation relation of the form $$Y=A+(B-A)X(c) \qquad \text{(Eq.1)}$$

In this relation c represents the fraction portion (below radix point) of the memory address data. X(c) is permitted to be arbitrary and is required to satisfy the condition $0 \leqq X(c) \leqq 1$ for $0 \leqq c \leqq 1$. If $X(c)=c$, the familiar simple case of linear interpolation is obtained. This is a rather limited version of data interpolation because it only attempts to weight a stored data point with some function of the fractional difference between the points.

Prior art systems for reducing noise produced by the use of non-integer frequency division to address data from waveshape memories are not completely effective in that the residual noise is not reduced to an inaudible sound level.

It is an object of the present invention to reduce the residual noise in a non-integer frequency divider waveshape memory system to a lower level than that attainable with prior art systems.

SUMMARY OF THE INVENTION

Since interpolation for values intermediate between two successive waveshape data points does not completely eliminate addressing noise in a non-integer type of frequency divider, it is essential that more information be employed by using a larger number of the available waveshape data points. It is noted that the sequentially addressing out of a stored set of waveshape data points is equivalent to a sampled set of data points. It is well known in the signal theory art that if a signal is limited to a band of frequencies f in the finite range $-W \leqq f \leqq W$ and if the signal is known at discrete intervals of time $t_n=n/2W$, $\infty < n < \infty$, then the original sampled signal f(t) can be recovered from the given set of discrete amplitude values f(n/2W) by summing weighted values of the discrete samples according to the relation $$f(t) = \sum_{n=-\infty}^{\infty} f(n/2W)\sin[2\pi(2Wt-n)]/[2\pi(2Wt-n)] \qquad \text{(Eq. 2)}$$

Since f(t) is a periodic function in the case of a waveshape sequentialy and repetitively addressed from a memory, then knowledge of the sample points for one complete period is exactly equivalent to having a complete set of sample points for all time. The smoothing function is of the form sinx/x. This function has amplitude values that decrease fairly rapidly with x as x increases in absolute value. By judicious choices in the number of data points used in a finite series approximation to Eq. 2, good outputs that are very low in background noise can be obtained for the original sampled and stored waveshape.

The present invention is directed to an arrangement for a non-integer divider for synthesizing clock pulse trains at the musical frequencies which can be utilized in a polyphonic tone synthesizer of the type described in the above-described U.S. patents. The undesired noise effects described above are reduced below audible levels. Thus, the present invention permits a tone generator to generate all the note of the musical scale using a single master clock timing clock.

In brief, this is accomplished by providing a non-integer divider in the form of a modulo one adder-accumulator which is incremented periodically at the master clock rate by an amount determined by a frequency number selected from a stored frequency number list. The list comprises the binary numbers corresponding to the ratios of the frequency of each note of the keyboard to the frequency of the next highest note of the scale above the highest note on the keyboard. Thus the ratios are all less than one in value. The adder-accumulator produces an overflow signal whenever the accumulated sum exceeds or equals the value of one. The overflow signals shift a set of successive data words from a register storing a master data list of amplitude values for the tones being generated. To compensate for noise introduced by the irregular time pattern of the pulses produced by the non-integer frequency divider, each number of the set of output data values from the register is multiplied by an appropriate value of the smoothing function sinx/x. The sum of these weighted output data values is then transferred to a digital-to-analog converter which creates the output analog musical waveshapes.

DETAILED DESCRIPTION

The present invention is directed to an improvement in the note clock generating system for a polyphonic tone synthesizer of the type described in detail in U.S. Pat. No. 4,085,644 entitled Polyphonic Tone Synthesizer and which is hereby incorporated by reference. In the following description, all portions of the system which have been described in the referenced patent are identified by two digit numbers which correspond to the same numbered elements used in the patent. All blocks which are identified by three digit numbers correspond to elements added to the polyphonic tone synthesizer to implement the improvement of the present invention.

Figure 1:
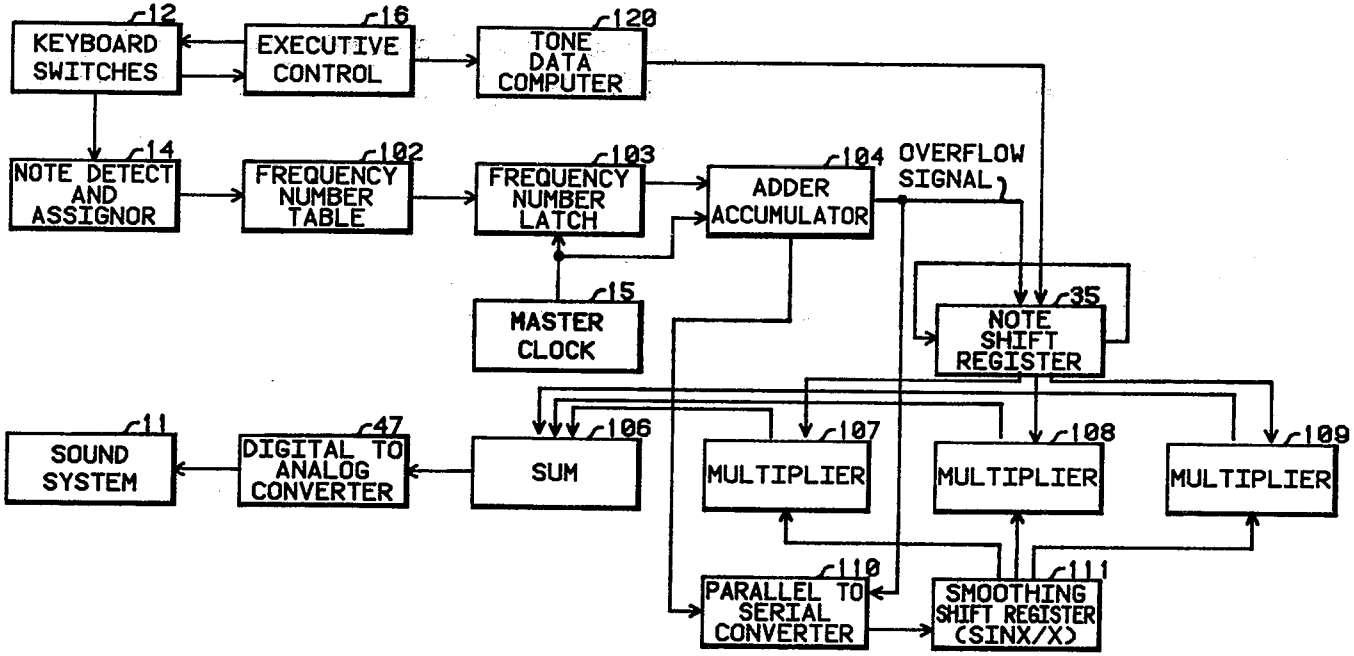
FIG. 1 is a schematic diagram of an embodiment of the invention.

FIG. 1 shows an embodiment of the present invention which reduces the noise produced by a memory addressing system employing non-integral frequency division.

Sound System 11 indicates generally an audio sound system capable of receiving and mixing up to twelve separate audio signals. Each input signal to the sound system is generated by its own tone generator in response to the actuation of a key on a convention musical keyboard. The keys operate a corresponding keyswitch on the keyboard switches 12. Up to twelve keys may be operated simultaneously to generate as many as twelve simultaneous tones. It will be understood that a polyphonal system having twelve tones is only given by way of example and does not represent a system limitation.

Whenever a key on the beyboard actuates a switch, note detect and assign circuit 14 stores information as to the particular note on the keyboard and assigns that key to one of the twelve tone generators in the system which is not currently assigned. The note information and the fact that it has been assigned to a tone generator is stored in a memory (not shown) in the note detect and assignor circuit 14. The operation of a suitable keyboard note detect and assignor circuit is described in U.S. Pat. No. 4,022,098 entitled Keyboard Switch Detect And Assignor which is hereby incorporated by reference.

Whenever a key is actuated the executive control 16 causes a master data list, or data set, to be calculated and transferred to a note shift register 35. The note shift register 35 is one of a identical set of twelve such registers of which only one is drawn explicitly in FIG. 1. The master data list consists of consecutive points on one period of the waveshape of a preselected musical tone. The master data list is calculated in a tone data computer 120 in a manner specifically described in the above referenced U.S. Pat. No. 4,085,644. As therein described, the master data list for a given tone consists of a set of 64 data words. Each such data word represents the amplitude of a point on a single cycle of the musical tone to be generated. Depending upon which tone generator has been selected by the keyboard detect and assignor 14, the calculated master data list is transferred to one of a set of twelve note shift registers such as the note shift register shown in FIG. 1.

When a key has been actuated and it has been identified as to its corresponding musical note on the instrument's keyboard, a corresponding frequency number is addressed out from the frequency number table 102 and is stored in a data register indicated by the frequency number latch 103. There are a set of twelve such data registers, each corresponding to one of the set of twelve tone generators.

The frequency number table 102 is a read-only addressable memory containing data words in binary form having the values $2(-N/12)$ where N has the range of values $N=1, 2, \ldots, M$ and M is equal to the number of keys on the musical instrument's keyboard. The frequency numbers represent the ratios of the fundamental frequencies in an equal tempered musical scale. A detailed description of the frequency numbers is contained in U.S. Pat. No. 4,114,496 entitled Note Frequency Generator For A Polyphonic Tone Synthesizer which is hereby incorporated by reference.

There are a set of twelve adder-accumulators one of which is shown explicitly in FIG. 1 as adder-accumulator 12. One of these adder-accumulators is associated with a member of the set of twelve tone generators.

A frequency number, when transferred to the frequency number latch 103 is used to control the frequency of the shift pulses applied to the corresponding note shift register 35 using the timing signals from the master clock 15. To this end, the number stored in the frequency number latch 103 is applied to an input of an adder-accumulator 104. The accumulator is implemented to be modulo one and advantageously has a word length capacity of 14 bits. The adder-accumulator 104 adds the frequency number received from the frequency number latch 103 to the contents of the accumulator at each clock pulse furnished by the master clock 15. Since the frequency number is always less than one, the addition of successive frequency numbers causes the accumulator to increment one or more times before the accumulator content reaches or exceeds a total equal to or in excess than one. Because the accumulator is modulo one, the accumulator generates an overflow signal whenever the addition of the frequency number to the contents of the accumular causes it to read or exceed one.

The adder-accumulator 104 continues to be incremented by the frequency number until a new keyboard switch is assigned to the same tone generator. When a new assignment is made, the accumulator may be cleared and the preceding procedure is repeated with the new frequency number. It is not necessary that the accumulator be cleared.

The adder-accumulator 104 operates as a non-integer frequency divider for the master clock pulses since it generates an overflow signal with each master clock pulse signal which causes the accumulator to reach or exceed the value one. A detailed description of this action is given in the above referenced U.S. Pat. No. 4,114,496. In particular, an explanation is furnished which shows that the time spacing between the overflow signals are in general not equal increments. Equal time increments will occur for the special cases in which the frequency number is selected to be a rational number such as 0.5, 0.25, etc.

An alternative to the use of a frequency number table 102 is to generate these numbers upon demand by employing a simple calculation routine such as that described in the previously referenced U.S. Pat. Nos. 3,639,913 and 3,743,755. In such systems a constant multiplier is used having a value equal to the decimal number $2^{-1/12}=0.9438743$. Upon demand for a frequency number the calculation is made by using an itterative loop starting at the highest note for the instrument and continuing until the loop terminates at the note number for which the frequency number is required. At each stage the number $2^{-1/12}$ is multiplied by itself so that at the end of the loop the result is the frequency number $2^{-P/12}$ where P is the number of musical note counted from the highest note on the keyboard. Similar calculations can, of course, be made by proceeding from the lowest note and using the constant multiplier $2^{1/12}$.

The number of bits used to represent the frequency number will affect the frequency accuracy of the generated musical note. The accuracy is a function of the note's fundamental frequency for a fixed number of bits representing the frequency number. The higher notes have the greatest accuracy which decreases for lower notes. Advantageosly 14 bits are used to represent a frequency number. This choice yields a tuning error of two cents at the fundamental frequency corresponding to the musical note $C_2$ (f=65.406 hz). A worst case tuning error of two cents is tolerable for most musical instruments.

The overflow signals from the adder-accumulator 104 are used to replace the signals produced by the note clock 37 shown and described in the referenced U.S. Pat. No. 4,085,644. Thus the master list stored in the note shift register is shifted out in response to the unequal time spaced overflow signals generated by the adder-accumulator 104.

The system as thus far described, would produce a distorted or "noisy" wave form for the associated analog signal because of the non-integer frequency divider action of the adder-accumulator 104. This "noise" is noticeable and objectionable to the listener because of its high level relative to the desired tone and because it has strong non-harmonic components.

The level of the unwanted noise is reduced by using an appropriate data smoothing applied to a set of consecutive words selected from the master data list.

The note shift register 35 is operated in an end-around mode in which data appearing at the output is rewritten as the current input data. Multiple signals are obtained from the last set of data words stored in the note shift register. The best noise reduction is obtained if the number of output signals is equal to the number of data words stored in the note shift register. For the preferred embodiment the note shift register 35 has a capacity of 64 data words.

Corresponding to each signal output from the note shift register 35 is a member of a plurality of multipliers. These are shown symbolically in FIG. 1 as the set of multipliers 107 through 109.

The second input to each member of the plurality of multipliers is otained from the outputs of the smoothing shift register 111. The smoothing shift register 111, for the case in which there are 64 multipliers, contains 512 data words calculated according to the relation $$x_n=\sin(\pi n/8)/(\pi n/8) \qquad \text{(Eq. 3)}$$

for integer values of the index n ranging from −256 to +255.

The output data taps on the smoothing shift register are separated by eight data words.

The products obtained from the plurality of multipliers 107 through 109 are added together in sum 106. The resultant number after the adding is converted to an analog signal by means of the digital-to-analog converter 47. The converted analog signal is transferred to the sound system 11.

The final step in the noise reduction system is to modify the output smoothing data from the smoothing shift register in response to the current value in the accumulator contained in adder-accumulator 104. To this end, the smoothing shift register is shifted in response to the three most significant bits in this accumulator. The restriction to three significant bits corresponds to selection of 512 data words in the smoothing shift register 111. Thus there are 512/64=8 smoothing function values for each master data word stored in the note shift register 35.

The three most significant bits contained in the accumulator of the adder accumulator 104 are converted into a corresponding serial pulse train by means of the parallel to serial converter 110. This serial pulse train is used to advance the smoothing function data stored in the smoothing shift register 111.

At the time an overflow signal occurs, the smoothing shift register 111 is advanced 512−N+M positions. N is the number of positions that this register was advanced at the immediately preceding overflow signal time and M is the number of positions that the smoothing shift register 111 must be advanced at the current time in response to the three most significant bits in the adder accumulator 104.

In analogy with the note shift register 35, the smoothing shift register 111 is not shifted in equal amounts because its advance is also controlled by a non-integer frequency divider.

Instead of using the full set of 64 available signals contained in the note shift register a more economical system is one that used only the last eight output data words. The main economy results in the reduction of the number of multipliers from 64 to 8.

When eight signals are used, 64 data words are stored in the smoothing function shift register 111 which are computed according to the relation $$x_n=\sin(\pi n/8)/(\pi n/8) \qquad \text{(Eq.4)}$$

for integer values of the index n from −32 to 31. In this case the smoothing shift register is advanced by 64−N+M positions at the time of an overflow signal.

The use of 8 data signals instead of 64 signals does not provide the best noise reduction. However, even with 8 data signals the noise reduction for such a non-integer memory addressing system is better than prior art systems.

Figure 2:
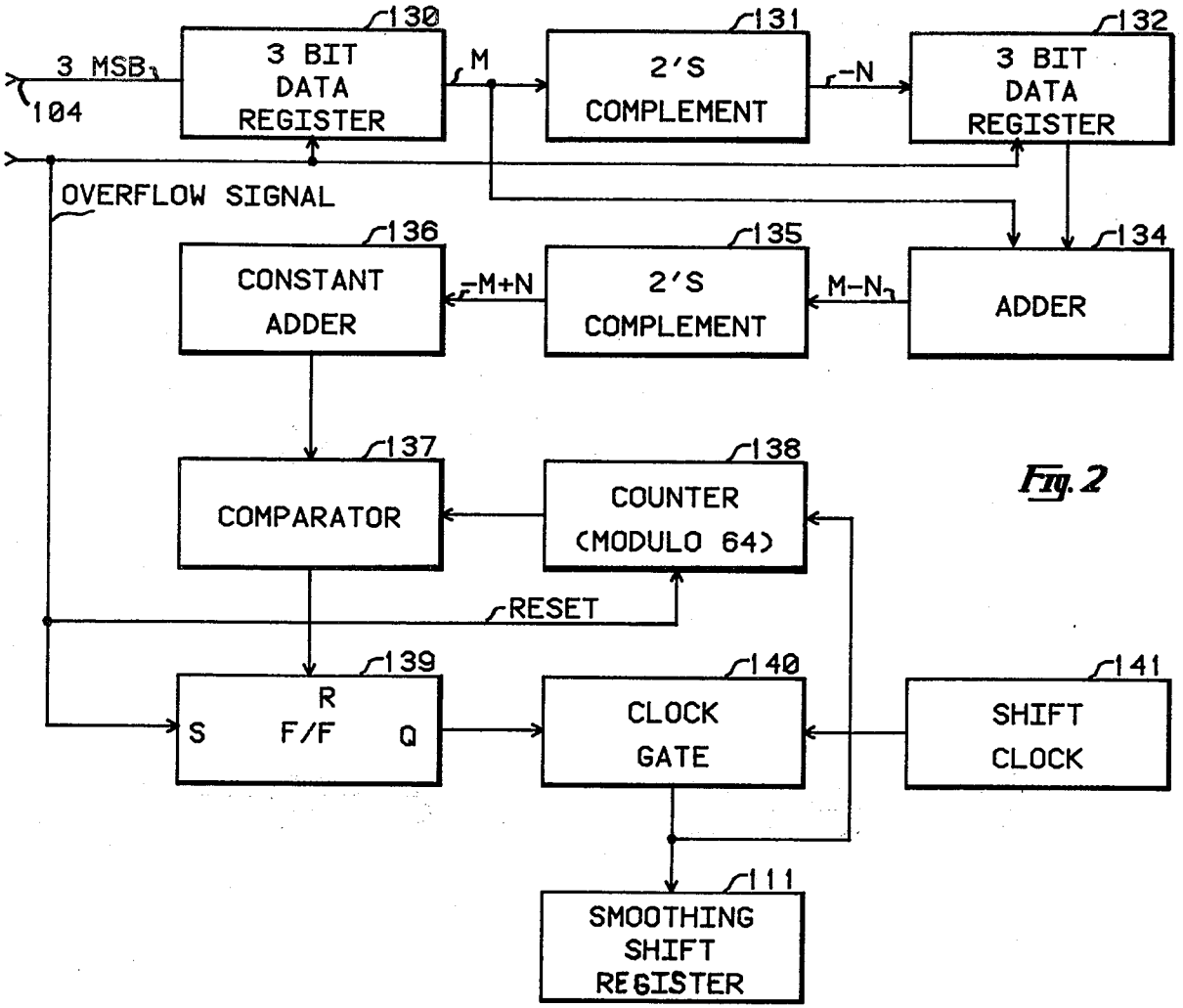
FIG. 2 is a schematic drawing of parallel data to serial pulse clock circuitry.

FIG. 2 illustrates the details of the parallel to serial converter 110. The three MSB (most significant bits) from adder accumulator 104 are transferred into temporary storage in the 3 bit data register 130 at the time at which the overflow signal is generated. At the same time the prior data in this register is transferred to the 3 bit data register 132 after a 2's binary complement is performed. Thus data register 130 contains the current 3 MSB represented in value by M and data register 132 contains the negative of the prior value −N. The value M−N, as a binary number is contained in adder 134. The value M−N, as a binary number, is converted to −M+N by means of the 2's complement 135. The constant adder 136 provides the desired value, as a binary number, of 64−M+N which is the number of data words by which the smoothing shift register must be advanced.

Flip-Flop 139 is set by the overflow signal. For an output state of Q="1" of the flip-flop, clock gate 140 allows clock pulses from the shift clock 141 to be transferred to the smoothing shift register 111 and to the counter 138. Counter 138 is implemented to count modudulo 64. This counter is reset to its initial state in response to the overflow signal.

Comparator 137 performs a comparison between the data 64−M+N provided by the constant adder 136 and the current state of the counter 138. When these two quantities are equal, flip-flop 139 is reset and thereby terminates the shift pulses being transferred to advance the smoothing shift register.

The shift clock 141 must operate at a speed higher than that of the master clock 15. If the master data list contains 64 data words, then the shift clock frequency which can accomodate the highest note should be no lower than $f = f_{C7} \times$ No.words in master list $\times$ No.words in smoothing register $f = 2093 \times 64 \times 64$ $f = 8.57$ Mhz.

Figure 3:
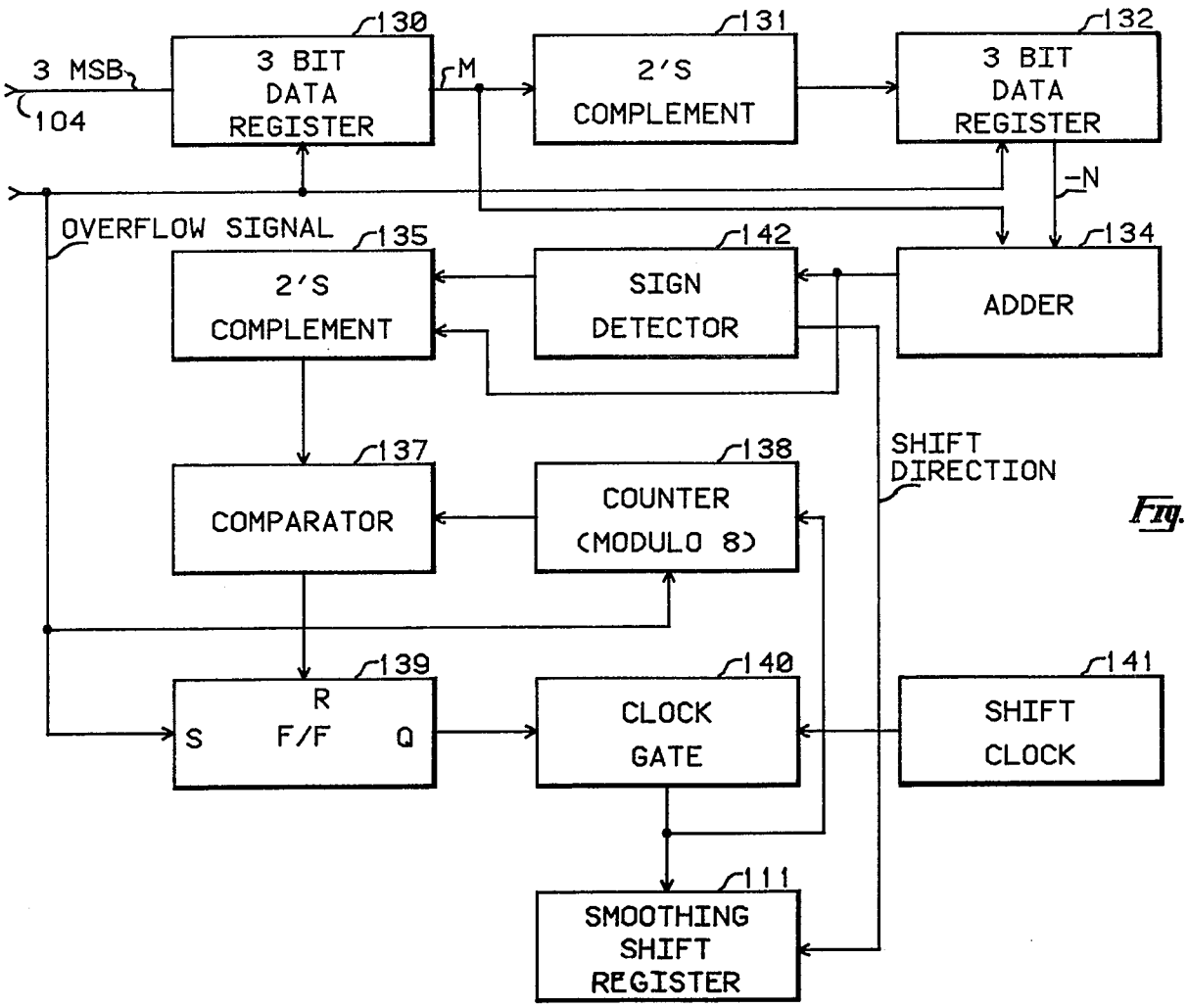
FIG. 3 is an alternate schematic drawing of parallel data to serial pulse clock circuitry.

An alternative shift system is shown in FIG. 3. In this system a bi-directional shift register is used to implement the smoothing shift register 111. Since the maximum number of word shifts is 7 corresponding to the three MSB of the adder-accumulator 104, the shift clock frequency in this implementation should be no lower than $f = f_{C7} \times$ No.words in master list $\times 7 = 0.94$ Mhz.

In the system shown in FIG. 3 for the parallel to serial converter 110, the smoothing shift register is advanced, or retarded, by an amount M−N. The selection of advance or retard is determined by the algebraic sign of the quantity M−N. If the algebraic sign is positive, then the data is advanced in the smoothing shift register.

As described above for FIG. 2, the adder 134 contains the quantity −N as a binary number in 2's complement form. The sign detector 142 determines the algebraic sign of M−N. If the algebraic sign is not negative, then the shift direction signal set to the bi-directional smoothing shift register 111 will cause the data contained in this device to advance in response to its input clock signals transmitted via clock gate 140.

If the algebraic sign is not negative, then M−N is transferred unaltered to the comparator 137. The overflow signal sets the flip-flop 139 and resets the counter 138 to its initial state. When the flip-flop 139 is set, clock pulses from the shift clock 141 are transferred via clock gate 140 to the smoothing shift register 111 and the counter 138. Counter 138 is implemented to count modulo 8. When the state of the counter reaches the absolute value of M−N, comparator 137 resets the flip-flop 139 and thereby terminates the transfer of shift clock pulses to the smoothing shift register 111.

If M−N is a negative number, the sign detector causes the smoothing shift register 111 to reverse the data shift direction in response to the shift clock pulses transferred via clock gate 140. A negative sign detected by sign detector 142 causes a 2's complement operation to be performed on M−N before this quantity is presented to comparator 137. In this fashion a positive number always appears in the comparator 137 to be compared with the current count state of the counter 138.

It is evident that the note registers, such as note register 35, can be replaced by a read-write addressable memory (RAM). In such a system, six additional bits are added to the accumulator word length in the adder-accumulator 104. The current word address is determined by the six most significant bits. The shift information data sent to the parallel to serial convererter will now consist of bits 7,8,9 where bits 1,2,3,4,5,6 represent the MSB of the binary data word in the accumulator.

Figure 4:
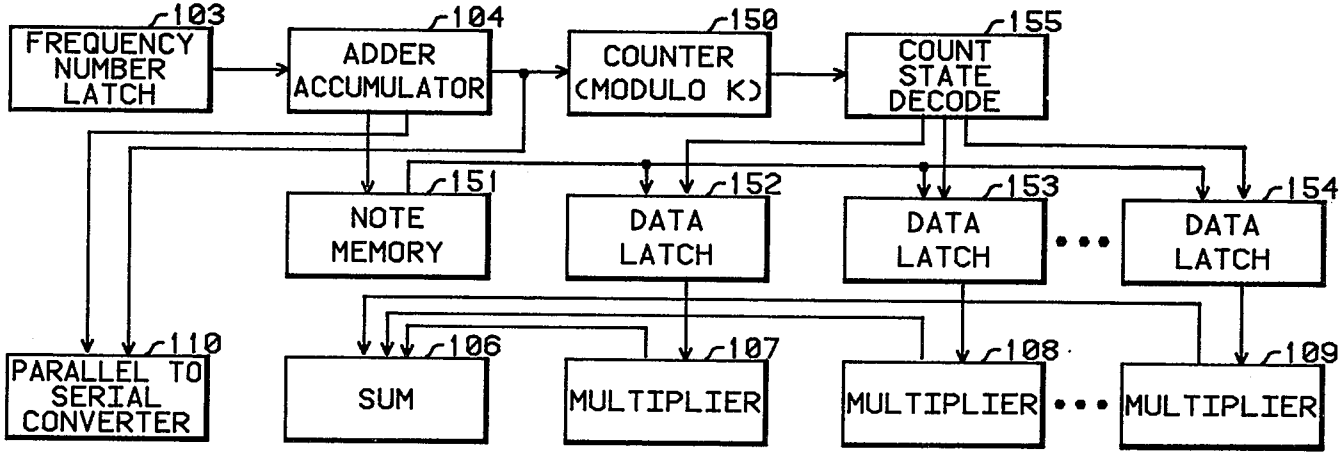
FIG. 4 is a schematic diagram of an alternative embodiment of the invention.

FIG. 4 shows the system logic for the alternative system in which the master list for each of the plurality of tone generators is transferred and stored in an addressable read-write memory such as note memory 151. The first six MSB of the accumulator contents in the adder accumulator are used to address data words out from the note memory 151.

The overflow signal from the adder-accumulator 104 is generated when bit number 6 changes state. Counter 150 is incremented by the overflow signals and is implemented to count modulo K. K is the number of data points from the master data set that are used in the smoothing operation.

Count state decoder 155 decodes the current state of counter 150 to provide data clocking signals to the plurality of K data latches shown symbolically as data latch 152 through 154. The master data set word addressed out from the note memory 151 is stored in one of the R data latches corresponding to the current state of counter 150. In this fashion the plurality of data latches contain the most recent R data points from the master data set that have been accessed from the note memory 151. The data is stored in a cyclic order under control of the counter 150.

Figure 5:
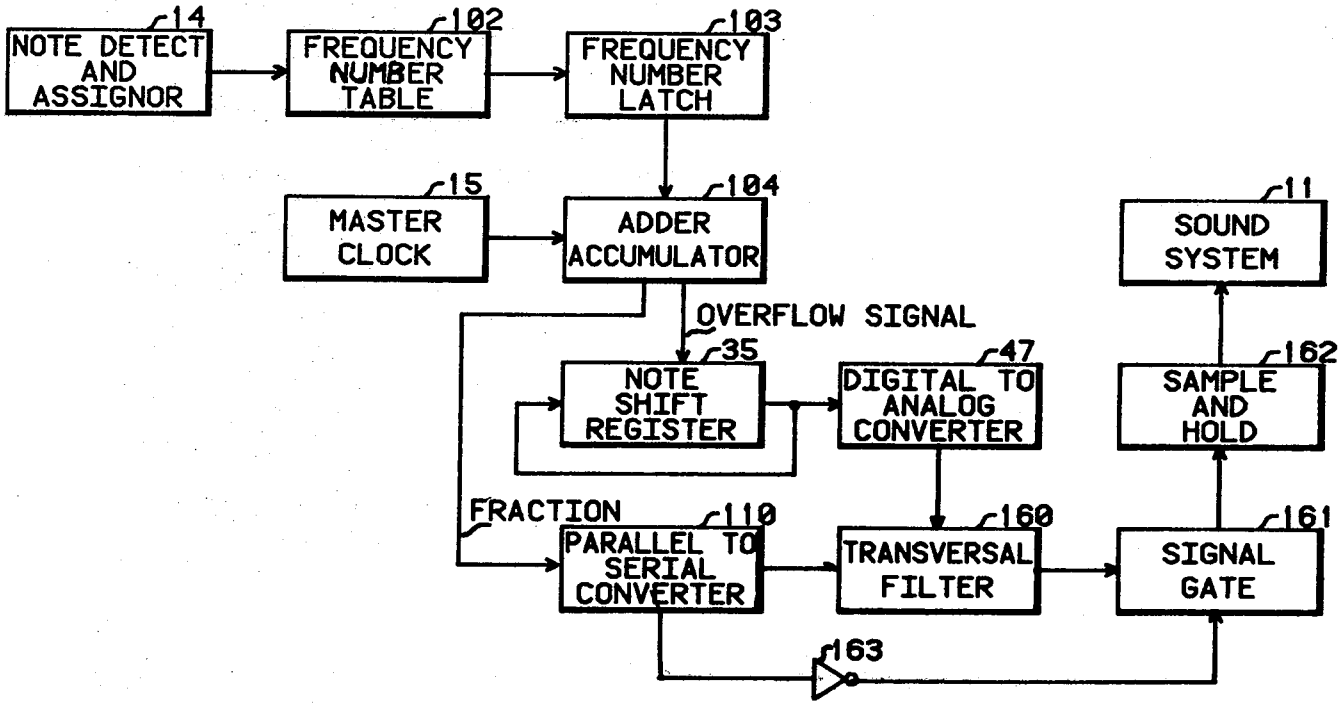
FIG. 5 is a schematic diagram of an embodiment of the invention using analog signal processing.

FIG. 5 shows an alternative implementation of the present invention in which the noise produced by the use of an non-integer frequency divider is reduced by applying an equivalent smoothing operation on the analog signals following the digital-to-analog conversion rather than on the digital data directly accessed from the note shift register 35.

In the system shown in FIG. 5 only one data point from the stored master data set is accessed in response to the overflow signal generated by the adder accumulator 104. The accessed data words from the note shift register 35 are converted to analog signals by means of the digital to analog converter 47 and applied to the input of the transversal filter 160.

The transversal filter 160 is advantageously implemented using a CCD (charge coupled device) as described in detail in the co-pending application U.S. Ser. No. 046,135 filed June 6, 1979, entitled Apparatus For Reducing Noise In Digital To Analog Conversion by the same inventor and hereby incorporated by reference. The details of a preferred embodiment of the transversal filter are shown in FIG. 13 of the referenced patent application. This filter can be implemented for any number of input data words, however a miximum of 64 suffices for the master data set comprising 64 data points. The transversal filter consists of a CCD device which acts as an analog shift register. An output signal port is implemented for each stage of the CCD. The signal at each output port is scaled using a resister divder so that the scale factors correspond to Eq. 4 where n now denotes the number of a signal port. An analog adder provides a single output signal for the sum of these scaled individual signals. For economy reasons, the transversal filter can be implemented for 8 input data words which will provide adequate noise reduction for most practical musical instruments.

The parallel to serial converter 110 can be implemented as shown in FIG. 3 or FIG. 4 depending upon whether or not the transversal filter is uni or bi-directional. In either case, a signal gate 161 is used to inhibit the changes in the output of the transversal filter 160 during the data shift from reaching sound system 11. Invertor 163 receives the output Q from the flip-flop 139 in either configuration of the parallel to serial converter 110. In response to the signal from inverter 163, the signal gate 161 will only transfer the output of the transversal filter 160 to the sample and hold 162 only while the transversal filter is stationary after being shifted in response to the first three MSB bits from the accumulator in adder accumulator 104.

The sample and hold 162 functions to maintain a constant analog signal level during the time interval in which the transversal filter is shifted.

While all the systems used to illustrate the invertion were described using the preferred smoothing function of the sinx/x form, it is obvious that other smoothing functions can be employed and the invention is not limited solely to the sinx/x function. For example, a $J_O(x)$ function can also be used. $J_O(x)$ denotes the Bessel function of zero order and argument x. This Bessel function resembles the sinx/x function and has its first zero at the value of the argument $x=2.40483$. To obtain data smoothing values for use with a system which operates on the L most recent points, the interval $x=2.4083$ is divided into L equal segments to determine the intervals at which the Bessel function is to be evaluated to obtain a set of smoothing function points.

I claim

1. In combination with a keyboard musical instrument having a waveshape memory storing a plurality of data words corresponding to the amplitudes of a corresponding number of evenly spaced points defining a cycle of an audio musical signal and in which said data words are sequentially and repetitively read out of the waveshape memory and transferred to a digital-to-analog converter at an average rate proportional to the pitch of the musical tone being generated wherein said average rate is generated by a non-integer frequency divider, apparatus for reducing undesired frequency components produced by said non-integer frequency divider comprising;

a waveshape memory storing in memory locations said plurality of data words, a frequency number means for providing digitally coded values corresponding to the fundamental frequencies of musical notes produced by said musical instrument, a first clock means for providing timing clock pulses, assignor means whereby a frequency number is accessed from said frequency number means in response to an actuated key on said keyboard, an adder-accumulator means, operative at each timing clock pulse from said first clock means, wherein said frequency number accessed by said assignor means is added to the contents of said adder-accumulator and wherein the adder-accumulator generates an overflow signal whenever the accumulated value exceeds the capacity of the accumulator, a first addressing means whereby a sequence of M consecutive data words are cyclically and repetitively addressed out from said waveshape memory and wherein the waveshape memory location of the first data word in said sequence of consecutive data words is advanced by said overflow signal, a smoothing memory storing smoothing function data values, a second addressing means responsive to the contents of said adder-accumulator means whereby a sequence of smoothing function data values equal in number to said number M are addressed out from said smoothing memory, a plurality of multiplying means, each corresponding to one of said plurality of M data words addressed out from said waveshape memory, wherein said addressed data words are multiplied by said smoothing function data values addressed out from said smoothing memory, a summing means for adding all the product values provided by said plurality of multiplying means to generate an output data set and thereby reducing said undesired frequency components, and a signal conversion means wherein the output of said summing means is converted to an analog signal.

2. A musical instrument according to claim 1 wherein said smoothing function memory stores smoothing function data values computed according to the relation $$x_n = \sin(\pi n/M)/(\pi n/M)$$

where n is the index corresponding to a data word location in said smoothing function memory and M is the number of data values in said plurality of data words addressed out from said waveshape memory.

3. A musical instrument according to claim 1 wherein said smoothing function memory stores smoothing function data values computed from values of the Bessel function $J_O(A)$ for increments of A equal to 2.4083/M where M is the number of data values in said plurality of data words addressed out from said waveshape memory.

4. A musical instrument according to claim 1 wherein said smoothing memory comprises a shift register operated in an end-around mode in which data values shifted to the register output are rewritten as input data values.

5. In combination with a keyboard musical instrument having a waveshape memory storing a plurality of K data words corresponding to the amplitudes of a corresponding number of evenly spaced points defining a cycle of an audio musical signal and in which said data words are sequentially and repetitively read out of the waveshape memory and transferred to a digital-to-analog converter at an average rate proportional to the pitch of the musical tone being generated wherein said average rate is generated by a non-integer frequency divider, apparatus for reducing undesired frequency components produced by said non-integer frequency divider comprising;

a waveshape memory storing said plurality of K data words, a frequency number means for providing digitally coded values corresponding to the fundamental frequencies of musical notes produced by said musical instrument, a first clock means for providing timing clock pulses, assignor means whereby a frequency number is accessed from said frequency number means in response to an actuated key on said keyboard, an adder-accumulator means, operative at each timing clock pulse from said first clock means, wherein said addressed out frequency number is added to the sum previously contained in said adder-accumulator and wherein the adder-accumulator generates an overflow signal whenever the accumulated value exceeds the capacity the accumulator, a second clock means for providing shift clock pulses, a data memory, digit select circuitry responsive to said overflow signal wherein a predetermined number of the most significant bits are selected from the contents of said adder-accumulator means and stored in said data memory, pulse selection circuitry responsive to said oerflow signal for selecting a consecutive number of $K-M+N$ clock pulses from said second clock means where K is equal to said plurality of data words in said waveshape memory, M is the current value of the most significant bits selected by said digit select circuitry, and N is the value of said most significant bits stored in said data memory, a first addressing means responsive to said overflow signal whereby a plurality of H data words are addressed out in sequence from said waveshape memory, where the address of the first data word in said sequence is advanced by said overflow signal, and H is a number not larger than said number K, a smoothing memory storing smoothing function data values, a second addressing means whereby a sequence of smoothing function data values equal in number to said number H are addressed out from said smoothing memory and wherein the memory address of the start of said sequence smoothing function data values is responsive to said selected number of $K-M+N$ clock pulses, a plurality of multiplying means, each corresponding to one of said plurality of H data words addressed out from said waveshape memory, wherein said data words are multiplied by said smoothing function data values addressed out from said smoothing memory, a summing means for adding all the product values provided by said plurality of multiplying means and thereby reducing said undesired frequency components, and a signal conversion means wherein the output of said summing means is converted to an analog signal.

6. A musical instrument according to claim 1 wherein said smoothing function memory comprises a bi-directional shift register operated in an end-around mode attained by causing output data to be written as input data and wherein the shift direction is responsive to a shift control signal.

7. A musical instrument according to claim 6 wherein said pulse selection circuitry further comprises;

sign detector circuitry for determining the algebraic sign of said quantity $M-N$ and wherein a forward shift control signal is provided to said smoothing function memory if $M-N$ is a positive number and whererein a backward shift control signal is provided if $M-N$ is a negative number.

8. A musical instrument according to claim 6 wherein said frequency number means comprises an addressable memory storing digitally coded values corresponding to the frequencies of musical notes produced by said musical instrument.

9. In combination with a keyboard musical instrument having a waveshape memory storing a plurality of K evenly spaced points defining a cycle of a musical waveshape and in which said data words are sequentially and repetitively read out of the waveshape memory and transferred to a digital-to-analog converter at an average rate proportional to the pitch of the musical tone being generated wherein said average rate is generated by a noninteger frequency divider, apparatus for reducing frequency components produced by the noninteger frequency divider comprising;

a waveshape memory storing said plurality of K data words, a frequency number means for providing binary digitally coded values of frequency numbers corresponding to the fundamental frequencies of musical notes produced by said musical instrument, a first clock means for providing timing clock pulses, assignor means whereby a binary digitally coded frequency number is accessed out fromm said frequency number means in response to an actuated key on said keyboard, an adder-accumulator means, operative at each timing clock pulse from said clock means, wherein said accessed binary digitally coded frequency number is added to the sum previously contained in said adder-accumulator and wherein the adder accumulator generates an overflow signal whenever a change occurs in the state of a preselected bit position of said sum, a first addressing means responsive to contents of said adder-accumulator means whereby a data word is addressed out from said waveshape memory in response to said overflow signal, a plurality of data storage means, of number H, storing said data words addressed out from said waveshape memory wherein the selection of the first data storage means in said cyclic order is advanced in response to said overflow signal, a smoothing memory storing smoothing function data values, a second addressing means responsive to the contents of said adder-accumulator means whereby smoothing function data values equal in number to said number H are addressed out in sequence from said smoothing memory, and wherein the address of the first one of said sequence of smoothing function data values is determined by said contents of said adder-accumulator means, a plurality of multiplying means, each corresponding to one of said plurality H of data storage means, wherein the contents of said data storage means are multiplied by said smoothing function data words addressed out from said smoothing memory, a summing means for adding all the product values provided by said plurality of multiplying means to generate an output data set and thereby reducing said undesired frequency components, and a signal conversion means wherein the output from said summing means is converted to an analog signal.

10. In combination with a musical instrument having a waveshape memory storing a plurality of data words corresponding to the amplitude of K evenly spaced points defining a cycle of a musical waveshape and in which said data words are sequentially and repetitively read out of the waveshape memory at an average rate proportional to the pitch of the musical tone being generated wherein said average rate is generated by a noninteger frequency divider, apparatus for reducing frequency components produced by the noninteger frequency divider in the audible output musical signal comprising;

a first clock means for providing timing clock signals, a waveshape memory storing said plurality of K data words, a frequency number generating means wherein a digitally coded value is created corresponding to the fundamental frequencies of musical notes produced by said musical instrument, assignor means whereby a frequency number is selected from said frequency number generating means in response to an actuated key on said keyboard, an adder-accumulator means, operative at each timing clock signal from said first clock means, wherein said selected frequency number is added to the sum previously contained in the adder accumulator and wherein the adder-accumulator generates an overflow signal whenever a change occurs in the state of a preselected bit position, a waveshape memory addressing means responsive to contents of said adder-accumulator means for addressing out data words from said waveshape memory in response to said overflow signal, a signal conversion means whereby data words addressed out of said waveshape memory are converted into analog signals, a filter means wherein a preselected consecutive number of said data words converted by said conversion means are stored in sequence and individually weighted and summed thereby reducing said undesired frequency components, and wherein each such data word addressed out of said waveshape memory is stored and a previously stored data word is discarded, and a signal utilization means comprising a sound system for converting the summed output from said filter means into an audible musical sound.

11. A musical instrument according to claim 10 wherein said frequency number generating means comprises a memory storing digitally coded values corresponding to the fundamental frequencies of musical notes produced by said musical instrument.

12. A musical instrument according to claim 10 wherein said filter comprises a charge coupled device having a plurality of output signal ports which scale each stored value according to the relation $x_n = \sin(n/N)/(n/N)$ where n is the index corresponding to a memory position in the charge coupled device, and N is said number of said plurality of data words.

13. A musical instrument according to claim 10 wherein said filter comprises a charge coupled devicice having a plurality of output signal ports which scale each stored value according to values computed from the Bessel function $J_O(A)$ for increments of A equal to 2.4083/N where N is the number of data values in said plurality of data words.

14. In combination with a musical instrument having a waveshape memory storing a plurality of data words corresponding to the amplitude of K evenly spaced points defining a cycle of a musical waveshape and in which said data words are sequentially and repetitively read out of the waveshape memory at an average rate proportional to the pitch of the musical tone being generated wherein said average rate is generated by a noninteger frequency divider, apparatus for reducing frequency components produced by the noninteger frequency divider in the audible output musical signal comprising;

a first clock means for providing timing clock signals, a waveshape memory storing said plurality of K data words, a frequency number generating means wherein a digitally coded value is created corresponding to the fundamental frequencies of musical notes produced by said musical instrument, assignor means whereby a frequency number is selected from said frequency number generating means in response to an actuated key on said keyboard, an adder-accumulator means, operative at each timing clock signal from said first clock means, wherein said selected frequency number is added to the sum previously contained in the adder-accumulator and wherein the adder-accumulator generates an overflow signal whenever a change occurs in the state of a preselected bit position, a waveshape memory addressing means responsive to contents of said adder-accumulator means for addressing out data words from said waveshape memory in response to said overflow signal, a signal conversion means whereby data words addressed out of said waveshape memory are converted into analog signals, a filter means wherein a preselected number of said data words converted by said conversion means are stored and individually weighted and summed thereby reducing said undesired frequency components, a second clock means for providing shift clock pulses, digit select circuitry responsive to said overflow signal wherein a predetermined number of the most significant bits are selected from the contents of said adder-accumulator means, pulse selection circuitry responsive to said overflow signals for selecting a number of said shift clock pulses equal in number to said most significant bits selected by said digit select circuitry, signal advance circuitry responsive to said selected shift clock pulses for shifting data contained in said filter means, and a signal utilization means comprising a sound system for converting the summed output from said filter means into an audible musical sound.

* * * * *

UNITED STATES PATENT AND TRADEMARK OFFICE

CERTIFICATE OF CORRECTION

PATENT NO. : 4,256,003

DATED : March 17, 1981

INVENTOR(S) : Ralph Deutsch

It is certified that error appears in the above-identified patent and that said Letters Patent are hereby corrected as shown below:

Column 1, line 36 change "As" to --An--.

Column 1, line 39 change "idenficiation to --identification--.

Column 1, line 58 change "Eash" to --Each--.

Column 2, line 8 change "sngle" to --single--.

Column 3, line 21 change "abn" to --an--.

Column 3, line 40 change "182" to --3/4--.

Column 3, line 53 change "a" to --an--.

Column 5, line 48 change "beyboard" to --keyboard--.

Column 6, line 19 change "2(-N/12)" to the exponent form -- $2^{(-N/12)}$ --.

Column 11, line 33 change "2.40483" to --2.4083--.

Column 13, line 19 change "oerflow" to --overflow--.

Column 14, line 41, after "H," insert -- cyclically and repetitively --.

Signed and Sealed this

Thirtieth Day of June 1981

[SEAL]

Attest:

RENE D. TEGTMEYER

Attesting Officer

Acting Commissioner of Patents and Trademarks